US009192963B1

(12) United States Patent
Lunnemann et al.

(10) Patent No.: US 9,192,963 B1
(45) Date of Patent: Nov. 24, 2015

(54) UNITARY SCREEN FRAME AND DISCHARGE SPOUT APPARATUS AND SYSTEM

(71) Applicant: M-I L.L.C., Houston, TX (US)

(72) Inventors: Robert A. Lunnemann, Florence, KY (US); Bradley Jones, Crestview Hills, KY (US)

(73) Assignee: M-I L.L.C., Houston, TX (US)

( * ) Notice: Subject to any disclaimer, the term of this patent is extended or adjusted under 35 U.S.C. 154(b) by 15 days.

(21) Appl. No.: 14/268,099

(22) Filed: May 2, 2014

(51) Int. Cl.
*B07B 1/04* (2006.01)
*B07B 1/46* (2006.01)

(52) U.S. Cl.
CPC ... *B07B 1/04* (2013.01); *B07B 1/46* (2013.01); *B07B 2201/00* (2013.01); *B07B 2201/02* (2013.01)

(58) Field of Classification Search
CPC ..... B07B 1/04; B07B 1/46; B07B 2201/00; B07B 2201/02
USPC ..... 209/352, 370, 405, 408, 411, 412
See application file for complete search history.

(56) References Cited

U.S. PATENT DOCUMENTS

| | | | | | |
|---|---|---|---|---|---|
| 4,810,372 | A * | 3/1989 | Jones | 209/315 |
| 5,213,216 | A * | 5/1993 | Suehiro et al. | 209/236 |
| 5,398,816 | A * | 3/1995 | Senapati | 209/364 |
| 5,951,864 | A * | 9/1999 | Hazrati et al. | 210/388 |
| 6,050,422 | A * | 4/2000 | Peters et al. | 209/352 |
| 6,129,216 | A * | 10/2000 | Vandewinckel et al. | 209/660 |
| 2005/0247603 | A1 * | 11/2005 | DeCenso et al. | 209/235 |
| 2006/0226052 | A1 * | 10/2006 | Yu | 209/382 |
| 2009/0071878 | A1 * | 3/2009 | Bosse | 209/391 |
| 2009/0159507 | A1 * | 6/2009 | Mainwaring et al. | 209/366 |
| 2012/0125823 | A1 * | 5/2012 | Smith | 209/363 |

* cited by examiner

*Primary Examiner* — David H Bollinger

(57) ABSTRACT

An apparatus has a frame with a screen portion and a discharge portion adjacent thereto. The frame has a bottom surface and a substantially planar top surface. The top surface extends from the screen portion to the discharge portion. An opening located in the screen portion of the frame extends through the frame from the top surface to the bottom surface. A spout formed in the discharge portion has a shape of a hollow cylinder and extends through the frame from the top surface to the bottom surface. A system has a separator with an inlet into which material to be separated enters. A unitary screen frame has a screen portion and a discharge spout with a planar top surface extending from the screen portion to the discharge spout. A first portion of the material entering the inlet flows from the planar top surface to the discharge spout.

20 Claims, 6 Drawing Sheets

UNITARY SCREEN FRAME AND DISCHARGE SPOUT APPARATUS AND SYSTEM

BACKGROUND

In certain industries and/or applications, separating one material from a second material is often desired and/or required. Further, the separation of solids based upon the relative size of the solids is generally known in a variety of industries and/or applications. Typically, separation by size is performed for various reasons. For example, separation of a like material by size may be desired to categorize the material into different sizes. Certain sizes may be more valuable or desirable. Thus, separating and/or categorizing the material by size may optimize the value of the material for a subsequent sale of the separated material. Further, certain food products are separated by size for grading purposes. Certain sizes of a particular food product may be more valuable or desirable.

To this end, separators may be used to separate different materials and/or to separate like materials by size. Typically, separators may use screens having different mesh sizes. The screens may be arranged relative to one another to allow the smaller material that may pass through a top screen to flow onto the screen below so that the materials may be separated. A series of stacked screens may be used in the separator. Also, the separator may use vibration and/or other motion to aid in the separation process.

Conventional vibratory separators generally utilize screens of either hook strip or pretensioned design. The screens may be tensioned after the screens have been mounted in the basket of the vibratory screen apparatus. Two opposed ends of the screen are fitted with a turn back element to form a hook strip. The hook strip may be hooked around a tension rail which may be attached to the side wall of the basket. Typically, a tension bolt may be used. However, other loading means to apply tensioning and securing forces may be employed. Tightening the tension bolt may move the tension rail outwardly towards the walls of the basket to apply tension to the screen.

Hook strip screens may be pretensioned prior to mounting in the basket by attachment of the screen mesh element to an apertured support plate, typically by means of an adhesive. A screen having a plurality of mesh layers may be pretensioned. In some designs, layers of fused mesh may be corrugated prior to mounting to an apertured support plate and the hooks applied thereafter to the mesh-plate combination.

Hook strip screens have a number of disadvantages including the complex and time consuming mounting of the screen members in the basket which results in significant downtime of the vibratory screen apparatus and requires the use of multiple parts. Attaining the correct screen tension for the sieved material also involves intricate fine tuning. The screens may be easily damaged if too much force is applied when tightening the bolts or loading means to tension the screens.

A further disadvantage is the relatively poor sealing between the screen and the basket. The metal-on-metal seal often results in leakage. Unscreened material may pass through gaps between the screen and the basket and may mix with already screened material below the mesh screen. Attempts to overcome the poor seal by placing rubber strips and/or gaskets at the metal/metal interfaces are time-consuming. The strips and/or gaskets frequently loosen during vibration and become lost or lodged in the vibratory machine which obstructs and/or damages the machinery. In addition, applying tension to the screen when tightening the tension bolt adds undesirable stresses to the machine frame.

Pretensioned screens generally have one or more layers of mesh permanently bonded under tension onto a generally rigid steel and/or plastics material apertured plate support frame. The screen and frame are inserted into the basket and are normally secured in the machine by clamps.

Conventional pretensioned screen units with integral support frames have significant disadvantages. For example, conventional pretensioned screens may be bulky, heavy and difficult to handle, transport and store. Typically, the design may be complex, and the frames may be expensive to construct.

Further, the material and/or the product may build up and may be trapped between the spacing frame and other parts of the separator as the material and/or the product may be separated. Therefore, the machine must be taken apart for cleaning which may create a non-productive, labor-intensive step.

DETAILED DESCRIPTION

The embodiments disclosed herein relate generally to an apparatus and a system for separating materials. More specifically, embodiments disclosed herein relate to a unitary screen frame and discharge spout apparatus and system.

Screens may be used to filter particles in industrial filtration systems. For example, industrial separators may use screens to separate particles and/or material of different sizes. To promote separation, vibrational and/or circular motion may be applied to the screen.

Figure 1:
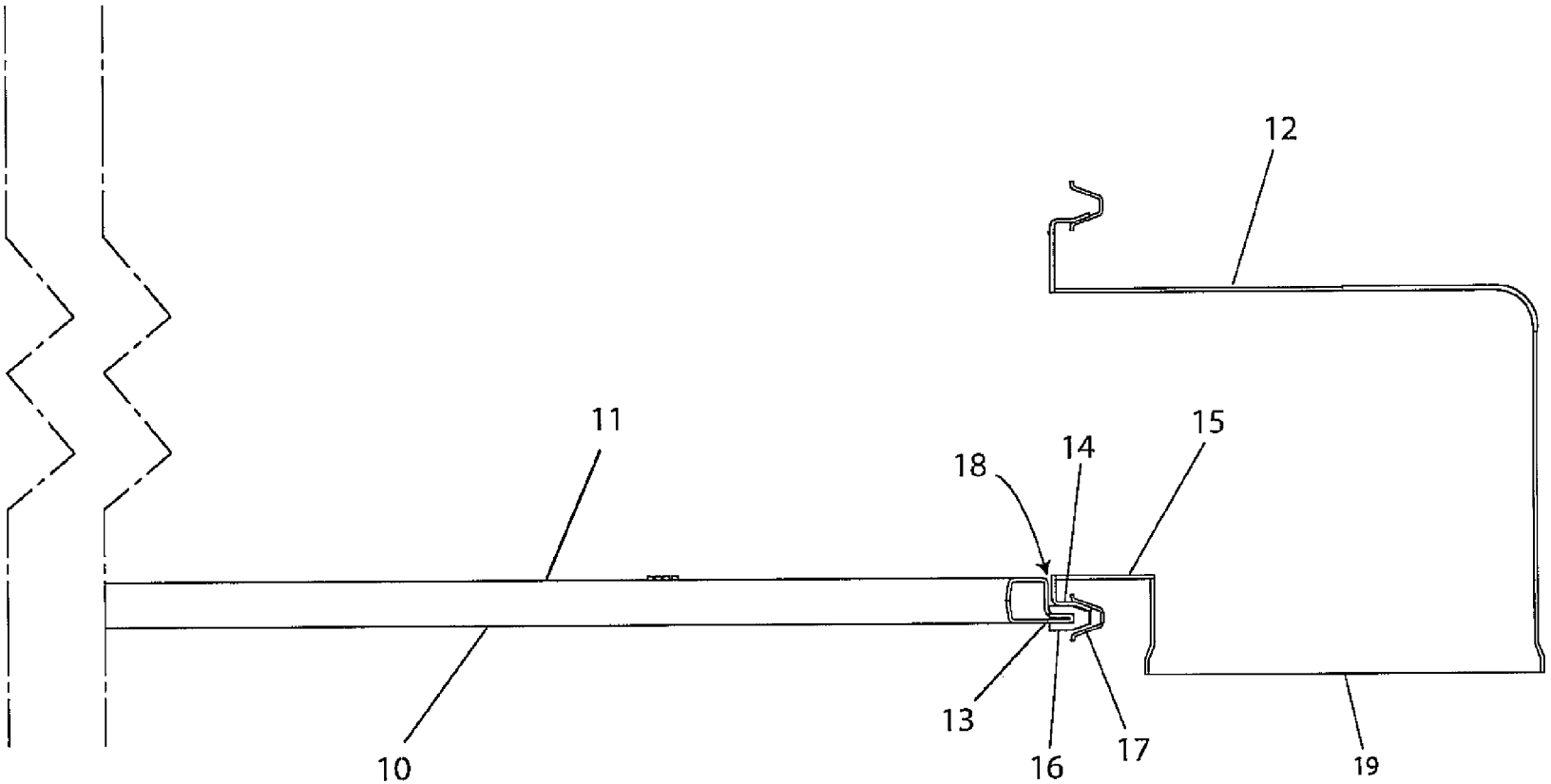
FIG. 1 Prior Art
FIG. 1 illustrates a prior art screen frame and a separate spout for use in a separator.

FIG. 1 illustrates a prior art screen frame 10 for use in a separator (not shown). The separator may be one of various types of separators, such as an industrial separator, a vibratory separator, a shaker and/or the like, for example. Generally, the screen frame 10 may have a single layer of mesh 11. Multiple layers of mesh may also be bonded together. The mesh 11 may be tensioned after mounting the screen frame 10 in the separator. Typically, the screen frame is metal. The screen frames 10 that may be used in separators are usually constructed of stainless steel. The manufacture of the screen frame 10 may require laser cutting, forming and/or welding.

The separator may have a spacing frame 12 that may connect to the screen frame 10. The screen frame 10 may be secured in the separator by using a hook strip mechanism. As shown in FIG. 1, the screen frame 10 may have a lip 13 that may extend from the outer periphery of the screen frame 10. The spacing frame 12 may have a flange 14 located an end 15 of the spacing frame 12. The lip 13 of the screen frame 10 may have a gasket 16 connected thereto. The flange 14 of the spacing frame 12 may be positioned against the gasket 16. A retaining clamp 17 may encompass the flange 14 of the spacing frame 12 and the gasket 16 connected to the lip 13 of the screen frame 12. The retaining clamp 17 may be tightened in a conventional manner to secure the screen frame 10 to the spacing frame 12.

As shown in FIG. 1, a gap 18 may be formed between the outer periphery of the screen frame 10 and the end 15 of the spacing frame 12. In use, material and/or product may be trapped in the gap and/or in other crevices that may be present within the separator. As a result, the material and/or the product may not pass through the separator and may not exit the separator through a discharge spout 19 formed in the spacing frame 12.

The material and/or the product may build up and/or may become trapped between the spacing frame and the screen frame as the material and/or the product passes over the screen frame 10. Since the material and/or product may remain in the separator, the separator may be taken apart for cleaning to avoid cross-contamination. As a result, the user may be required to perform a non-productive step and/or a labor-intensive step. Also, if such material and/or product may remain in the separator, the ability to run different products without cleanup between batches may be lost.

Referring to FIGS. 2-6, an integrated screen frame 100 in accordance with embodiments disclosed herein is illustrated. The integrated screen frame 100 may have a screen portion 101 and a discharge portion 102 integrally formed with the screen portion 101. The integrated screen frame 100 may have a top surface 103 that may be substantially planar. The top surface 103 may extend from the screen portion 101 to the discharge portion 102. Thus, the screen portion 101 and the discharge portion 102 may be integrally formed and may be substantially co-planar. The discharge portion 102 may have a discharge spout 104.

The integrated screen frame 100 may have a screen 105. The screen 105 may have a single layer of woven mesh wire or may be multiple layers of woven mesh wire. The screen 105 may be a mesh cloth. The screen 105 may have a mesh size to filter particles. For example, the screen 105 may have the mesh size to separate like material and/or different material into various categories based upon the size of the particles. The mesh size as used herein may refer to the size of the apertures in the screen 105. The screen 105 may be circular as shown in FIGS. 2-6. However, other shapes may be used as desired. The screen 105 may be arranged over an opening 106. The screen 105 may be attached to the top surface 103 of the screen portion 101 of the integrated screen frame 100. The screen may be embedded and/or molded to the screen portion 101 of the integrated screen frame 100.

Figure 2:
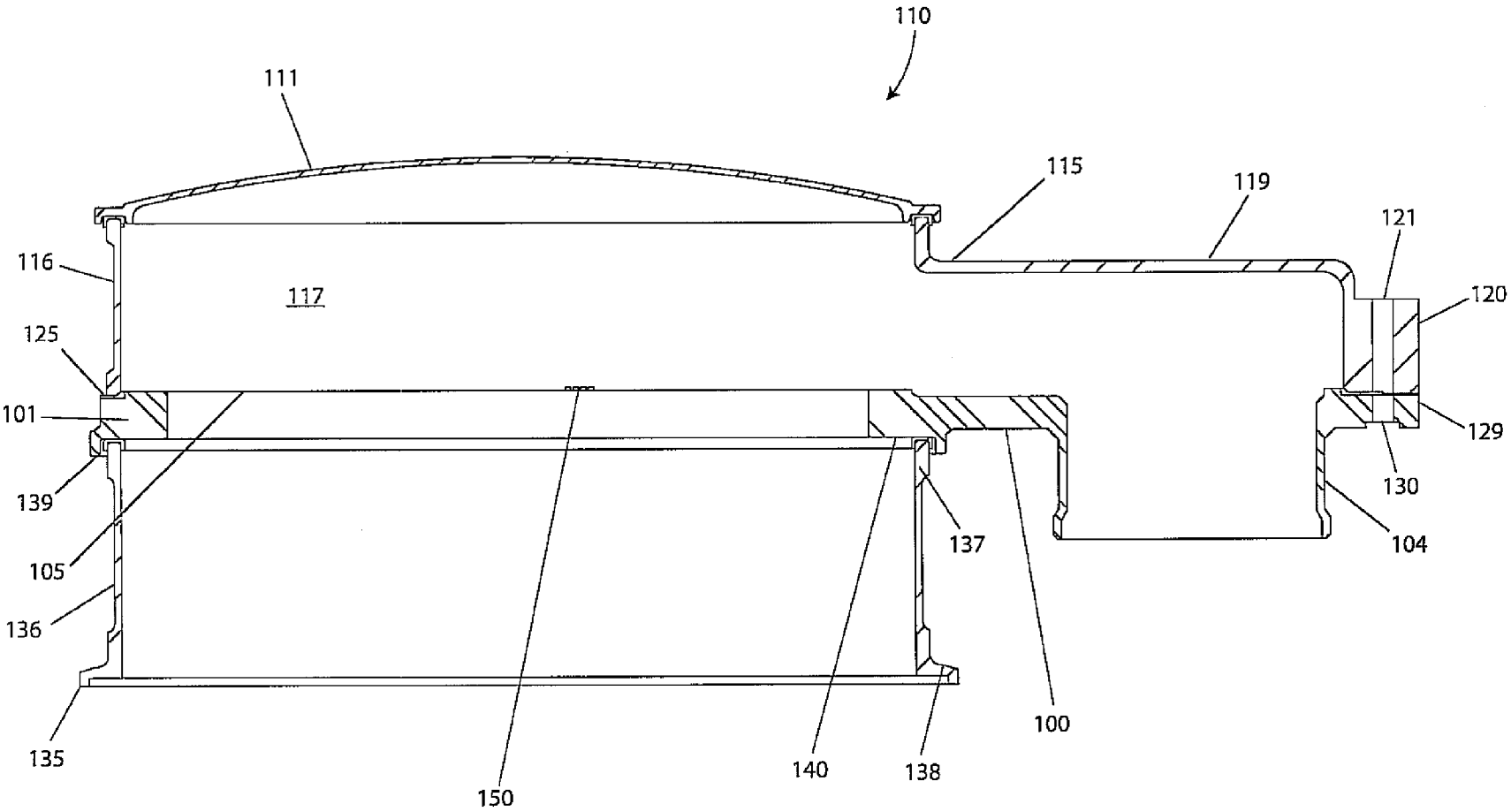
FIG. 2 illustrates a cutaway side view of a separator having an integrated screen frame in accordance with embodiments disclosed herein.
Figure 3:
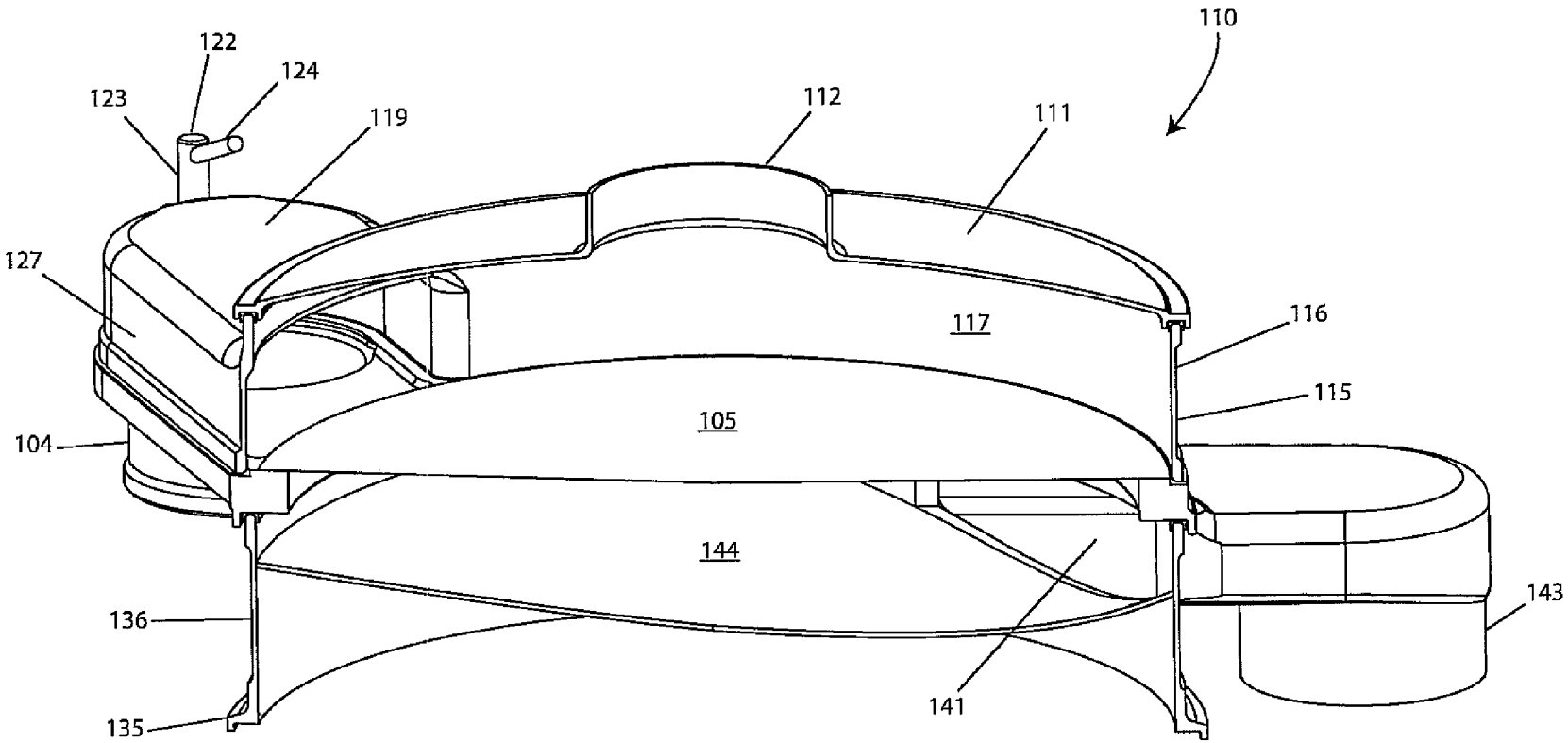
FIG. 3 illustrates a cutaway perspective view of the separator having the integrated screen frame in accordance with embodiments disclosed herein.
Figure 4:
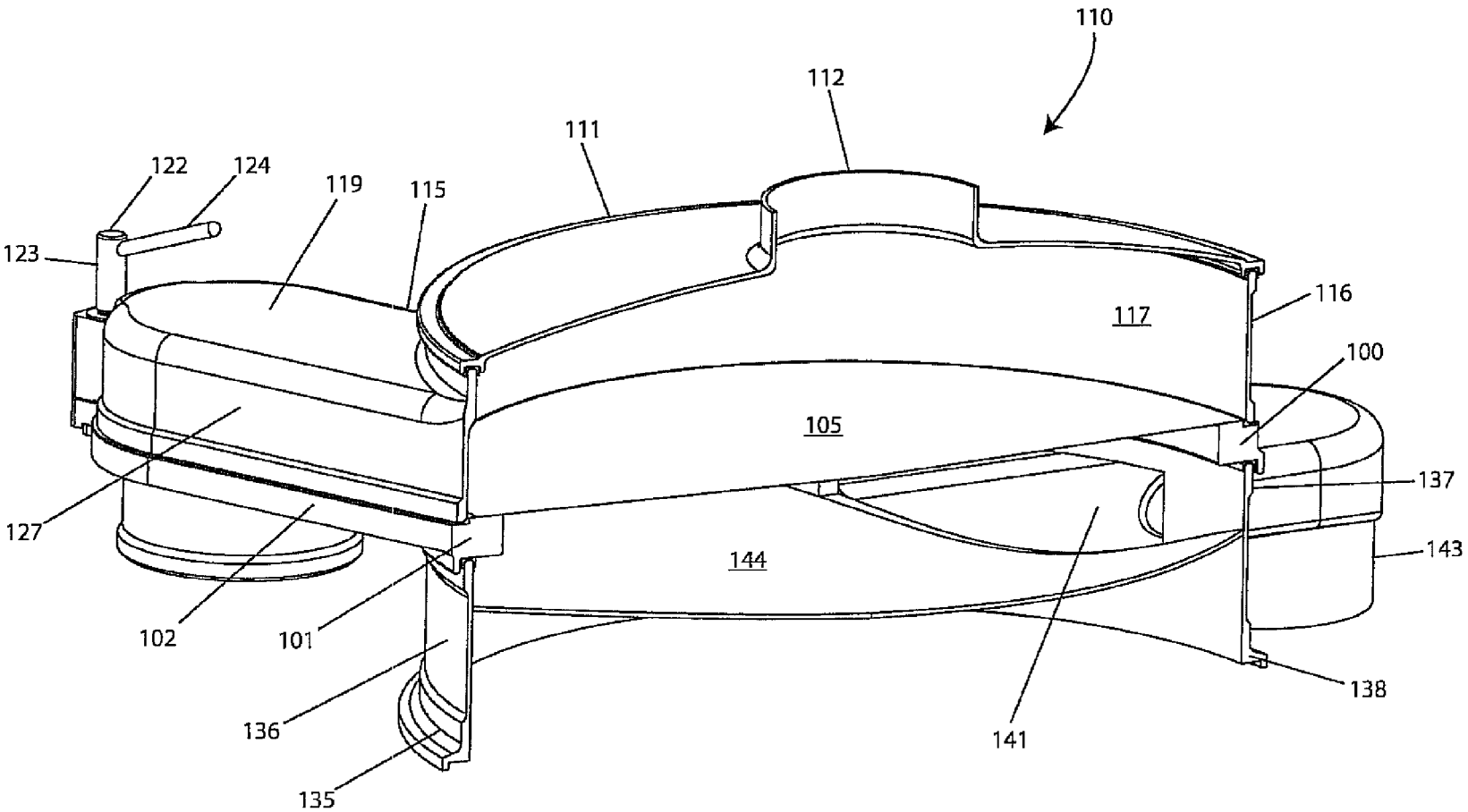
FIG. 4 illustrates a cutaway perspective view of the separator having the integrated screen frame in accordance with embodiments disclosed herein.
Figure 5:
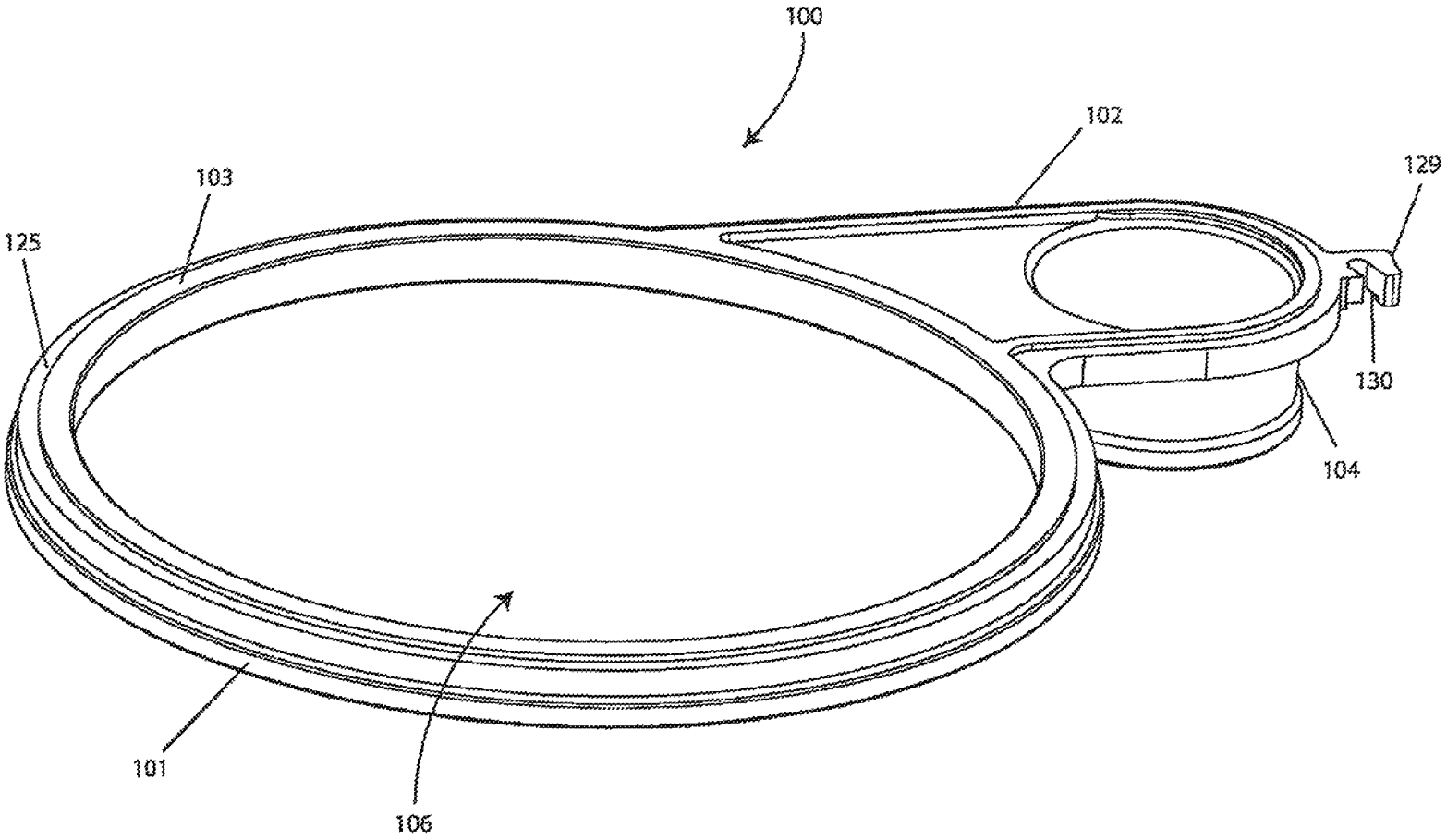
FIG. 5 illustrates a perspective view of the integrated screen frame in accordance with embodiments disclosed herein.
Figure 6:
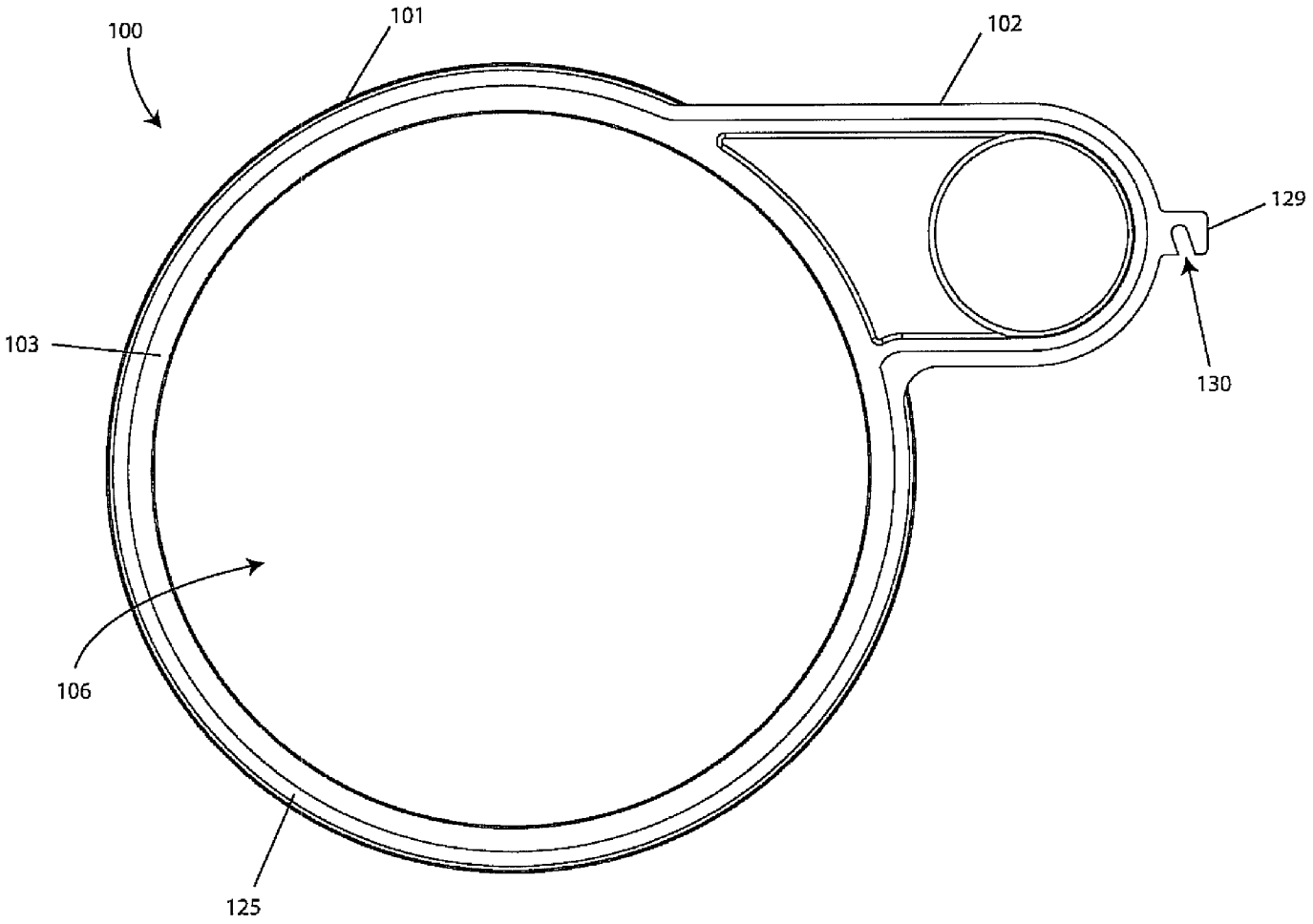
FIG. 6 illustrates a top view of the integrated screen frame in accordance with embodiments disclosed herein.

FIGS. 2-4 illustrate the integrated screen frame 100 mounted in a separator 110. For simplicity, the upper portion of the separator 110 is shown. In the illustrated embodiment, the separator 110 may have a generally circular shape. However, other shapes may be used, as desired. The shape of the integrated screen frame 100 may be coordinated to the shape of the separator 110 that may be used. In an embodiment, the separator 110 and the integrated screen frame 100 may be constructed from high performance injection molded composite plastics. An additive may be in the high performance injection molded composite plastics to make the separator 110 and the integrated screen frame 100 static dissipating. The separator 110 and the integrated screen frame 100 may feature internal geometry that may be smooth and/or gap free. Such gap free geometry may be preferred in applications, such as the food industry and/or the pharmaceutical industry, for example. Contamination may be reduced with such gap free geometry. Further, the gap free geometry may allow the ability to run different products without cleanup between batches due to the low levels of cross contamination that may occur in such a smooth, gap free environment.

As shown in FIGS. 2-4, the separator 110 may have a lid 111. The lid 111 may be generally circular in shape. The lid 111 may have an inlet 112 to provide a supply of material and/or product to the separator 110 for separation. The inlet 112 may be located approximately in the center of the lid 111. However, the inlet 112 may be positioned at other locations as desired. The separator 110 may also have a spacing frame 115.

The spacing frame 115 may have a body 116 defined by a wall 117. The body 116 may be generally circular in shape. The lid 111 which may also be circular may be attached to the body 116. The lid 111 may fit on the wall 117. The lid 111 and the body 116 of the spacing frame 115 may be secured together.

As shown in FIG. 2, the spacing frame 115 may also have an extended portion 119 that may extend outwardly from the body 116. The extended portion 119 may have an end 120 with a through hole 121 formed therein. The through hole 121 may be configured to receive a securing mechanism 122 as shown in FIGS. 3 and 4. The securing mechanism 122 may have a shaft 123 which may pass through the through hole 121. The securing mechanism 122 may also have a lever 124. Operation of the securing mechanism 122 may be described hereinafter.

As illustrated in FIGS. 2-6, the integrated screen frame 100 may have an upper recess 125 that may be formed in the periphery thereof. The upper recess 125 may be configured to receive the wall 117 of the body 116 of the spacing frame 115. The extended portion 119 of the spacing frame 115 may also have a wall 127. Further, the upper recess 125 may receive the wall 127 of the extended portion 119 of the spacing frame 115. The wall 117 of the body 116 of the spacing frame 115 and the wall 127 of the extended portion 119 may contact the upper recess 125 of the integrated screen frame 100. Thus, the upper recess 125 may form a seal with the spacing frame 115 around the complete periphery.

The integrated screen frame 100 may have a tab 129 that may be located at the outer periphery of the discharge portion 102. The tab 129 may have a notch 130 formed therein. The notch 130 may receive the shaft 123 of the securing mechanism 122. To operate the securing mechanism 122, the lever 124 may be moved to rotate the shaft 123 within the through hole 121 in the end 120 of the extended portion 119 of the spacing frame 115. The lever 124 may also be moved to rotate the shaft 123 within the notch 130 of the discharge portion 102 of the integrated screen frame 100. The securing mechanism 122 may be used to tighten the spacing frame 115 onto the upper recess 125 of the integrated screen frame 100. Rotating the lever 124 may draw together the spacing frame 115 and the integrated screen frame 100 to further tighten the seal formed between the upper recess 125 and the spacing frame 115.

The separator 110 may have a table frame 135 that may have a wall 136. The wall 136 may have a top edge 137 and a bottom edge 138. The integrated screen frame 100 may be located on the table frame 135. In particular, the integrated screen frame 100 may have a lower recess 139 that may be formed in a bottom surface 140 of the screen portion 101.

The table frame 135 may have an opening 141 in the wall 136. The opening 141 may provide a conduit to a discharge port 143. The table frame 135 may also have a shelf 144 that may be attached to the wall 136 and may be located between the top edge 137 and the bottom edge 138 of the wall 136 as shown in FIGS. 3 and 4.

In a separation operation in accordance with the embodiments disclosed herein, material and/or product 150 may enter the separator 110 through the inlet 112 in the lid 111. The material and/or the product 150 may contact the screen 105 on the integral screen frame 100 as shown in FIG. 2. The motion of the separator 110 may produce a spiraling of the material and/or the product 150. An operator of the separator 110 may make adjustments to parameters, such as weight settings, vibration, speeds, flows and/or the like to control the performance of the separator 110 for the desired separation of the material and/or the product 150.

The screen 105 may have the mesh size to filter particles of the desired size of the material and/or the product 150. For example, the screen 105 may have the mesh size to separate like materials and/or different materials into various categories based upon the size of the particles. The mesh size as used herein may refer to the size of the apertures in the screen 105. Particles of larger size than the mesh size may not pass through the screen 105 on the integral screen frame 100 during the separation operation. Such larger particles may be moved from the screen portion 101 to the discharge portion 102 of the integral screen frame 100. The larger particles may move toward the discharge portion 102 and may pass through the discharge spout 104. The screen portion 101 and the discharge portion 102 of the integral screen frame 100 may be integrally formed and may be substantially co-planar. The larger particles may pass without interruption through the discharge spout 104 without becoming trapped in gaps and/or crevices. Thus, the interior of the separator 110 may provide smooth, gap free surfaces for processing and/or separating the material and/or the product 150, as desired. The interior of the separator 110 may also be static dissipating.

In operation, particles of the material and/or the product 150 of a smaller size than the mesh size may pass through the screen 105 on the integral screen frame 100 during the separation operation. The material and/or the product 150 that may pass through the screen 105 may accumulate below the screen 105 on the shelf 144 within the wall 136 of the table frame 135. Operation of the separator 110 may transport the material and/or the product 150 from the shelf 144 through the opening 141 to the discharge port 143.

In the separation operation, particles of the larger size than the mesh size may not pass through the screen 105 on the integral screen frame 100 during the separation operation. Such larger particles may be moved from the screen portion 101 to the discharge portion 102 of the integral screen frame 100. The larger particles may move toward the discharge portion 102 and may pass through the discharge spout 104. The larger particles may be collected at the discharge spout 104 for further processing and/or packaging.

Also, the particles of the material and/or the product 150 of a smaller size than the mesh size may pass through the screen 105 on the integral screen frame 100 during the separation operation. The material and/or the product 150 that may pass through the screen 105 may accumulate below the screen 105 on the shelf 144 within the wall 136 of the table frame 135. Operation of the separator 110 may transport the material and/or the product 150 from the shelf 144 through the opening 141 to the discharge port 143. The smaller particles may be collected at the discharge port 143 for further processing and/or packaging.

While the present disclosure has been described with respect to a limited number of embodiments, those skilled in the art, having benefit of this disclosure, will appreciate that other embodiments may be devised which do not depart from the scope of the disclosure as described herein. Accordingly, the scope of the present disclosure should be limited only by the attached claims.

The invention claimed is:

1. An apparatus comprising:

a frame having a screen portion and a discharge portion adjacent to the screen portion wherein the frame has a top surface and a bottom surface wherein the top surface extends from the screen portion to the discharge portion and further wherein the top surface is substantially planar;

an opening in the screen portion of the frame extending through the frame from the top surface to the bottom surface; and a spout in the discharge portion wherein the spout has a shape of a hollow cylinder and further wherein the spout extends through the frame from the top surface to the bottom surface.

2. The apparatus of claim 1 further comprising:

a screen attached to the top surface of the frame wherein the screen is configured to cover the opening in the screen portion of the frame.

3. The apparatus of claim 1 further comprising:

a screen attached to the top surface of the frame wherein the screen is co-planar with the top surface of the frame.

4. The apparatus of claim 1 further comprising:

a screen in the screen portion of the top surface of the frame wherein the screen is co-planar with the top surface of the frame.

5. The apparatus of claim 1 wherein the opening in the screen portion is circular.

6. The apparatus of claim 1 wherein the spout extends below the bottom surface of the frame.

7. The apparatus of claim 1 further comprising:

an upper recess formed around the top surface.

8. The apparatus of claim 1 further comprising:

a lower recess formed around the bottom surface of the screen portion.

9. The apparatus of claim 1 wherein the frame is injection molded.

10. The apparatus of claim 1 further comprising:

an additive in the frame.

11. The apparatus of claim 1 wherein the frame is plastic.

12. The apparatus of claim 1 further comprising:

a tab extending outwardly from the frame wherein the tab has a notch configured to receive a securing mechanism.

13. A system comprising:

a separator having an inlet wherein material to be separated into a first portion and a second portion enters the inlet; and a unitary screen frame having a screen portion and a discharge spout with a planar top surface extending from the screen portion to the discharge spout wherein the first portion of the material flows from the planar top surface to the discharge spout.

14. The system of claim 13 further comprising:

a table frame having an internal shelf wherein the unitary screen frame is arranged on the table frame such that the second portion of the material passes through the screen portion of the unitary screen frame to the internal shelf of the table frame.

15. The system of claim 14 further comprising:

a discharge port connected to the table frame wherein the second portion of the material passes from the internal shelf of the table frame and exits the discharge port.

16. The system of claim 13 further comprising:

a spacing frame on the unitary screen frame wherein the spacing frame is configured to form a seal with the periphery of the unitary screen frame.

17. The system of claim 13 further comprising:

a securing mechanism configured to secure the unitary screen frame within the separator.

18. The system of claim 13 wherein the separator is plastic.

19. A system comprising:

a separator having an inlet and an outlet;

a screening apparatus having a discharge portion integrally formed with a screen portion with a mesh wherein the screening apparatus is positioned in the separator such that material to be separated into a first portion and a second portion passes from the inlet of the separator to the screening apparatus wherein the first portion of the material passes through the mesh and exits the outlet of the separator and the second portion of the material passes over the mesh to the discharge portion.

20. The system of claim 19 further comprising:

a planar top surface encompassing the screen portion and the discharge portion of the screening apparatus.

* * * * *